US012716691B2

(12) United States Patent
Lisbona et al.

(10) Patent No.: US 12,716,691 B2
(45) Date of Patent: Aug. 25, 2026

(54) PERSONAL BALLISTIC SHIELD WITH TRAUMA PROTECTION

(71) Applicant: MAJA LLC, Encino, CA (US)

(72) Inventors: Amnon Lisbona, Del Mar, CA (US); Antonio Cascini, Vimercate (IT); Maurizio Maranghi, The Woodlands, TX (US)

(73) Assignee: MAJA LLC, Encino (CA)

( * ) Notice: Subject to any disclaimer, the term of this patent is extended or adjusted under 35 U.S.C. 154(b) by 0 days.

(21) Appl. No.: 19/470,642

(22) PCT Filed: May 5, 2025

(86) PCT No.: PCT/US2025/027708
§ 371 (c)(1),
(2) Date: Sep. 29, 2025

(87) PCT Pub. No.: WO2025/231463
PCT Pub. Date: Nov. 6, 2025

(65) Prior Publication Data

US 2026/0118093 A1 Apr. 30, 2026

Related U.S. Application Data

(60) Provisional application No. 63/642,406, filed on May 3, 2024.

(51) Int. Cl.
*F41H 5/04* (2006.01)
*F41H 5/007* (2006.01)

(52) U.S. Cl.
CPC ..... *F41H 5/0457* (2013.01); *F41H 5/007* (2013.01)

(58) Field of Classification Search
CPC ..... F41H 5/0457; F41H 5/007
(Continued)

(56) References Cited

U.S. PATENT DOCUMENTS 5,996,115 A 12/1999 Mazelsky
6,997,218 B1 * 2/2006 Garcia ..... F41H 5/0435 2/2.5

(Continued)

FOREIGN PATENT DOCUMENTS

KR 101938469 B1 4/2019
KR 101938470 B1 4/2019

(Continued)

OTHER PUBLICATIONS

Search Report for International Patent Application No. PCT/US2025/027708, dated Jun. 16, 2025.

*Primary Examiner* — Samir Abdosh
(74) *Attorney, Agent, or Firm* — PEARL COHEN LLP

(57) ABSTRACT

A personal ballistic protective device has a ballistic impregnable barrier formed of steel or synthetic ballistic material, an anterior layer positioned on a front side of the ballistic impregnable barrier, the anterior layer comprising a polymeric material configured to absorb and retain bullet fragments upon projectile impact, and a posterior trauma protection layer positioned on a rear side of the ballistic impregnable barrier, the posterior trauma protection layer comprising a molded low-density polymeric foam, wherein the ballistic impregnable barrier includes at least one aperture providing fluid communication between the anterior layer and the posterior trauma protection layer, and wherein impact by a projectile causes airflow through the aperture from the anterior side to the posterior trauma protection layer to reduce trauma to the wearer.

12 Claims, 5 Drawing Sheets

(58) Field of Classification Search
USPC ..... 89/36.02
See application file for complete search history.

(56) References Cited

U.S. PATENT DOCUMENTS

| | | | | |
|---|---|---|---|---|
| 7,017,195 | B2 * | 3/2006 | Buckman | A61B 5/6804 2/455 |
| 7,540,228 | B1 | 6/2009 | Cronin et al. | |
| 7,954,416 | B2 | 6/2011 | Cioffi | |
| 8,327,462 | B2 | 12/2012 | Feldman et al. | |
| 10,648,779 | B1 | 5/2020 | Scalli | |
| 11,015,903 | B2 | 5/2021 | Inglefield et al. | |
| 2003/0188371 | A1 * | 10/2003 | Duhammel | A41D 13/018 2/102 |
| 2004/0118271 | A1 * | 6/2004 | Puckett | F41H 5/0428 89/36.02 |
| 2005/0193480 | A1 * | 9/2005 | Carlson | F41H 1/02 2/463 |
| 2012/0174754 | A1 | 7/2012 | Salisbury et al. | |
| 2012/0216324 | A1 * | 8/2012 | Medwell | F41H 1/02 2/2.5 |
| 2012/0246788 | A1 * | 10/2012 | Harrell | A41D 13/0155 2/243.1 |
| 2013/0212764 | A1 * | 8/2013 | Kent | A41D 13/0125 441/106 |
| 2015/0082503 | A1 * | 3/2015 | Beck | F41H 1/02 2/2.5 |
| 2015/0233678 | A1 | 8/2015 | Smith | |
| 2016/0138894 | A1 | 5/2016 | Heise | |
| 2017/0295860 | A1 * | 10/2017 | Hall | A41D 3/00 |
| 2019/0025015 | A1 | 1/2019 | Davis et al. | |
| 2019/0261705 | A1 * | 8/2019 | Lofgran | A41D 13/018 |
| 2023/0101875 | A1 | 3/2023 | Synnestvedt et al. | |
| 2023/0204328 | A1 * | 6/2023 | Adrain | E06B 9/382 89/36.02 |

FOREIGN PATENT DOCUMENTS

| | | | | |
|---|---|---|---|---|
| TW | M617909 | U | 10/2021 | |
| WO | WO 2005/045351 | A1 | 5/2005 | |
| WO | WO-2009097038 | A1 * | 8/2009 | F41H 1/02 |
| WO | WO-2013032533 | A1 * | 3/2013 | A41D 13/0155 |
| WO | WO-2017136936 | A1 * | 8/2017 | F41H 5/0485 |

* cited by examiner

PERSONAL BALLISTIC SHIELD WITH TRAUMA PROTECTION

CROSS-REFERENCE TO RELATED APPLICATIONS

This application is a National Phase Application of PCT International Application No. PCT/US2025/027708, International Filing Date May 5, 2025, claiming benefit of U.S. Provisional Application No. 63/642,406, filed May 3, 2024, which are hereby incorporated by reference.

FIELD OF THE INVENTION

The present invention relates to a personal ballistic protective device for dispersing and dampening ballistic impact forces to reduce the trauma caused by high impact forces created by ballistic weapons.

BACKGROUND OF THE INVENTION

In the past, ballistic vests used steel plates and/or other rigid, heavy materials to stop ballistic projectiles. Studies showed that heavy, uncomfortable body armor was less likely to be worn than lighter, more comfortable body armor. As a result, ballistic vest manufacturers developed lighter weight materials, such as synthetic fabrics comprising ballistic fibers (e.g., KEVLAR®) and other advanced fiber materials of high tensile strength, to provide lightweight yet effective protection.

The impact of a ballistic projectile, such as bullets of varying sizes and speeds, against a ballistic vest directs a significant impact force toward the torso of the wearer. While many types of lightweight armor provide relatively effective capability to stop ballistic projectiles, they often do little to stop, reduce and/or mitigate the transfer of kinetic energy from the ballistic projectile to the tissue that it is intended to protect. Unless the impact force is adequately dispersed, the impact force can produce to the wearer of the ballistic vest blunt force trauma that can result in severe internal injuries or death, even if the bullet itself has been stopped. In other words, even when lightweight armor is able to stop a bullet, the bullet can cause severe blunt trauma injury to underlying tissues.

Thus, ballistic protection device manufacturers must also devise ways in which to disperse the impact forces transferred through the ballistic vest toward the wearer's torso. Some ballistic vest manufacturers enclose within the ballistic vest one or more soft foam-like pads that are positioned proximal to the wearer's body when the ballistic vest is properly donned and that are intended to disperse the impact force over a larger area of the wearer's torso to thereby dampen the deformation and blunt force trauma directed to the wearer's torso. Other ballistic vest manufacturers employ inserts containing viscoelastic polymers or gels, ceramic plates and/or various metallic mechanical structures, frangible materials or pneumatic barriers for this purpose.

However, many of the current prior art personal ballistic protective devices that are intended to disperse ballistic impact forces either are too heavy or thick for practical use or do not sufficiently disperse impact forces to be effective. In fact, the landscape of commercially available bulletproof plates presents certain performance areas that can be improved, as discussed below.

The United States National Institute of Justice (NIJ) is a research, evaluation and technology agency of the U.S. Department of Justice dedicated to improving knowledge and understanding of crime and justice issues through science. As part of its mission to foster and disseminate knowledge and tools derived from objective and rigorous scientific research to inform efforts that promote safety and advance justice, the NIJ has issued a series of standards that specify the ballistic protection levels and associated test threats identified by U.S. law enforcement as representative of current prevalent threats in the United States for use to test and evaluate specific ballistic-resistant equipment against contemporary ballistic threats that pose a life-threating safety hazard to law enforcement officers. One recent NIJ standard for protection requires resistance to six 7.62×51 mm M80 NATO FMJ steel rounds at 15 meters, with a maximum backface deformation of 44 mm, and this regulation was updated to RF2, which introduces additional threats, including not only the M80 NATO round but also the 7.62×39 mm MSC 56, the 5.56 M193, and the 5.56 M855 rounds.

Bulletproof plates currently available on the market that meet the new RF2 standard introduced in 2024, revised in January 2025, are still very rare and difficult to analyze. As such, the current landscape of bulletproof plates is diverse, with products made from different materials and technologies.

Some common bulletproof vests use a polyethylene (PE) base generally coated with Aluminum Oxide or a ceramic base with various additives such as boron carbide, aluminum oxide, etc., both fully covered with a glued composite material. These devices allow for a low plate weight of less than 2.5 kg but, despite passing NIJ tests, allow trauma to be caused to the user (close to 40 mm) even after the first bullet and must generally be paired with a vest to contain bullet fragments. Moreover, these vests have short lifespans and are susceptible to saline and humid environments.

Another common bulletproof vest uses a ballistic steel base coated with polymers through immersion in tanks, allowing for very low thickness and cost, or with epoxy paint to prevent metal degradation. Some are also covered with injection-molded plastic material. Such a vest allows for a very long-lasting product (15-20 years) that is resistant to saline and humid environments but, despite passing NIJ tests, allows significant trauma to be caused to the user and must generally be paired with a vest to contain bullet fragments. This vest is also heavy, ranging from 3.2 kg to over 4 kg.

It is desirable for ballistic vest products to use a ballistic base that ensures product longevity, guarantees multiple-threat protection and that has the ability to stop multiple bullets. New ballistic steels and new processing techniques have been developed by manufacturing companies that reduce weight, as this remains a drawback for these products.

It is also desirable for ballistic vest products to eliminate or sufficiently minimize trauma to the user caused by a bullet capable of generating high energy (4,000-5,000 Joules, depending on distance and caliber). Even if such a bullet is stopped, such trauma could hinder the user's ability to flee or move, thereby endangering their life.

It is further desirable for ballistic vest products to maintain a slim and thin profile, e.g., anywhere from 11-15 mm of thickness, while retaining all the above strengths.

It is further desirable for ballistic vest products to function as a standalone product that can be used when needed without a bulletproof vest, for individuals at risk of an attack who prefer not to wear a vest for aesthetic or functional reasons.

What is needed is an improved thin and lightweight ballistic protection device that can function as a standalone product, stop a high energy projectile and also can avoid or significantly reduce blunt trauma injury to underlying tissues in the wearer of the ballistic protection device.

SUMMARY OF THE INVENTION

The invention described herein relates to a personal ballistic protective device, such as a barrier or armor, used to protect living beings from injury or damage by reducing trauma caused by the impact of bullets or other high-speed projectiles. More particularly, the invention relates to a thin and light personal ballistic protective device, such as a barrier or armor, that reduces the speed and energy of the shock wave that results from projectile impact by absorbing the kinetic energy received from the projectile and/or spreading the kinetic energy received from the projectile to a much larger area, thereby dispersing and dampening the trauma caused by the high impact forces created by ballistic weapons.

The personal ballistic protection device according to the invention has incorporated therein, generally as a central element, some sort of ballistic impregnable material, such as steel or another similar material that can withstand the impact of high caliber projectiles without breaking, cracking, fracturing or otherwise giving way. In preferred embodiments, this impregnable material is also lightweight. In preferred embodiments, the ballistic impregnable material forms the central core of the ballistic protection by protecting the user from bullets or other projectiles.

In certain embodiments, the personal ballistic protection device of the present invention has several different aspects of protection in which a steel plate, or another ballistic impregnable barrier, is sandwiched between different layers of material that is intended to provide trauma dispersing and dampening effect, either on the anterior side, i.e., front, ballistic impact, side, of the device, or on the posterior side, i.e., back, wearer side, of the device, or both.

In the present invention, the personal ballistic protection device has specific trauma protection on the posterior side (i.e., on the side of the ballistic impregnable material closer to the wearer) that provides a basic or enhanced level of trauma protection for the wearer. In some embodiments, the trauma pad can be a low-density polyurethane, or another such material known in the prior art.

In some embodiments, the device includes an anterior energy-absorbing layer anterior to a ballistic-resistant core configured to capture and retain projectile fragments, in addition to the posterior trauma mitigation layer that reduces blunt force trauma to the wearer.

In some embodiments, trauma mitigation is enhanced by airflow transfer from the anterior to the posterior side of the device, using the kinetic energy of the projectile, through at least one aperture in the ballistic-resistant core, enabling active inflation of a posterior airbag.

In some embodiments, an air-filled safety sac on the anterior side of the steel plate and an empty airbag on the posterior side of the steel plate are in fluid communication, and the force of impact of a bullet against the anterior side of the safety sac accelerates airflow from the air-filled safety sac on the anterior side, through the aperture, to fill and activate the airbag on the posterior side.

In one embodiment, the personal ballistic protective device comprises a ballistic impregnable barrier formed of steel or synthetic ballistic material; an anterior layer positioned on a front side of the ballistic impregnable barrier, the anterior layer comprising a polymeric material configured to absorb and retain projectile bullet fragments upon projectile impact; and a posterior trauma protection layer positioned on a rear side of the ballistic impregnable barrier, the posterior trauma protection layer comprising a molded low-density polymeric foam; wherein the ballistic impregnable barrier includes at least one aperture providing fluid communication between the anterior layer and the posterior trauma protection layer; and wherein impact by a projectile causes airflow through the aperture from the anterior side to the posterior trauma protection layer to reduce trauma to the wearer.

In some embodiments, the anterior layer comprises high-density polyurethane having a dual-hardness structure.

In some embodiments, the dual-hardness structure of the anterior layer comprises a harder outer shell enclosing a softer inner material. In some embodiments, the outer shell has a hardness of approximately 90 Shore, and the inner material has a hardness of approximately 65 Shore.

In some embodiments, the anterior layer has a structure configured to collect projectile fragments. In some embodiments, the anterior layer self-heals upon projectile impact by heat sealing a site of projectile penetration.

In some embodiments, the posterior trauma protection layer is shaped to conform to a wearer's torso.

In some embodiments, the posterior trauma protection layer comprises an inflatable airbag activated by fluid passing through the aperture. In some embodiments, the airflow through the aperture is accelerated by a Venturi effect.

In some embodiments, the anterior layer comprises a fluid-filled sac from which fluid, upon impact of a ballistic projectile onto the anterior layer, is forced through the aperture and into the inflatable airbag.

In some embodiments, the anterior layer comprises a structure that, upon penetration of a ballistic projectile into the anterior layer, allows entry of external air along with the projectile at a site of said projectile penetration. In some embodiments, the anterior layer self-heals upon projectile impact by heat sealing the site of projectile penetration, whereby the external air, by force of the ballistic projectile onto the anterior layer, is forced through the aperture and into the inflatable airbag.

In another embodiment, the personal ballistic protective device comprises a ballistic-resistant core; an anterior energy-absorbing layer positioned on a front side of the core; and a posterior trauma mitigation layer positioned on a rear side of the core; wherein the device is configured such, that upon impact of a ballistic projectile on the front side, energy from the impact is distributed through the anterior layer and transmitted to activate a trauma mitigation response in the posterior layer to thereby reduce blunt force trauma to a wearer.

In some embodiments, the trauma mitigation response comprises deformation of a posterior foam layer.

In some embodiments, the trauma mitigation response comprises inflation of a posterior airbag. In some embodiments, the posterior trauma mitigation layer includes an inflatable airbag.

In some embodiments, the anterior layer comprises a fluid-filled chamber whose fluid contents are transferred to the posterior airbag upon projectile impact.

In some embodiments, the anterior layer comprises a structure that, upon penetration of a ballistic projectile into the anterior layer, allows entry of external air along with the projectile at a site of said projectile penetration. In some embodiments, the anterior layer comprises a polymeric material configured to absorb and distribute impact energy.

The invention thus provides lightweight, thin, durable, and trauma-reducing ballistic protection for standalone or vest-mounted applications.

DETAILED DESCRIPTION OF THE INVENTION

Figure 1:
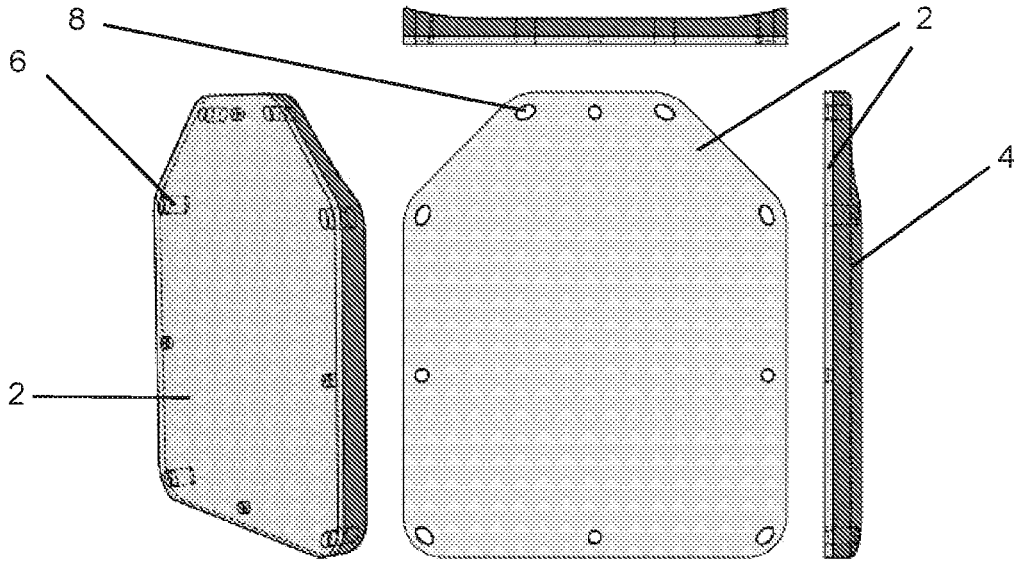
FIG. 1 shows perspective, front, end and side views of a ballistic impregnable barrier with an attached molded posterior anti-trauma layer.

Referring to the drawings, the personal ballistic protection device preferably has incorporated within it, generally as a central element, some sort of ballistic impregnable material that forms the core of the protection device, such as steel or another similar material that can withstand the impact of high caliber projectiles without breaking, cracking, fracturing or otherwise giving way. The ballistic impregnable material forms the central core of the ballistic protection by protecting the user from bullets or other projectiles.

In certain embodiments, this ballistic impregnable material is in the form of a plate that is joined to one or more additional layers of protective material. The ballistic impregnable plate can be formed of any such material known in the prior art, such as steel or an alloy steel carbon steel, carbon tool steel, spring steel, bearing steel, SCM steel, SNCM steel and boron-added steel, among others. Ballistic steel manufacturers have recently made progress in reducing weight by increasing resilience and decreasing metal thickness, thereby lowering the overall weight of the system.

In certain embodiments, this ballistic impregnable material can alternatively be a synthetic material, as known in the art, that is lightweight, flexible and has high impact resistance. One such material is Kevlar®, which is made from poly-para-phenylene terephthalamide fibers. Other such materials are graphene, ultra-high-molecular-weight polyethylene, nanotube mats, ballistic nylon, and others.

In preferred embodiments, the personal ballistic protection device according to the present invention comprises several layers of material aligned one against another to form a unitary, integrated personal ballistic protective device. For example, the device has several different aspects of protection, in which a steel plate or other ballistic impregnable barrier is layered with, or sandwiched between, different layers of softer material that is intended to provide some trauma dispersing and dampening effect, either on the anterior side, i.e., front, ballistic impact, side, of the device, or on the posterior side, i.e., back, wearer side, of the device, or both.

In some embodiments, for example as shown in FIG. 1, the ballistic impregnable barrier 2 may have a posterior anti-trauma layer 4 for additional trauma protection of the wearer. The additional posterior anti-trauma layer 4 may be an additional layer of material that is attached to the ballistic impregnable barrier 2 on the user-body side, using any known method, for example mounting pylons 6 that fit within attachment holes 8 that are pre-drilled into the ballistic impregnable barrier 2, for example as shown in FIG. 1.

In one embodiment, the posterior anti-trauma pad 4 can be formed of a polymeric foam layer, such as a low-density polyurethane, for example 48-128 kg/m$^3$ polyurethane foam, having a thickness of, e.g., 15 mm. Low density polyethylene foams (LDPE) are created with gaps in their cellular structure, creating a foam that is less dense and, therefore, softer and more compressive. The purpose of such a posterior layer is to reduce the blunt trauma force by providing a force-absorbing layer between the ballistic armor plate and the torso of the wearer.

In certain embodiments, the posterior anti-trauma layer can be molded to the contour of the wearer's body, specifically the torso, to enhance trauma protection. Molding of the posterior anti-trauma layer to the contour of the wearer's torso lessens the trauma by providing a larger surface area of contact between the trauma pad and the wearer, allowing the transferred force to disperse over this entire contact surface area. Appropriately sized and shaped, the anti-trauma layer mimics the user's anatomy, minimizing trauma caused by the kinetic energy of the projectile.

As shown in FIG. 1, molding of the posterior anti-trauma layer 4 to the contour of the wearer's torso also allows the use of a flat ballistic armor plate 2. While flat ballistic armor plates had originally been used years ago, more recent innovations in steel manufacturing allowed curved ballistic armor plates to be used, for better comfort and fit. However, curving ballistic armor adds stresses that weaken the steel. In addition, folding very hard steel with presses of 300 tons or more requires significant additional machine and operator costs, and so it is desirable to use flat plates where possible. Using a molded posterior anti-trauma layer permits this.

This molding of the anti-trauma layer to the contour of the wearer's torso can be done either at or after the time of purchase, after which the molded anti-trauma layer is affixed to the posterior side of the ballistic impregnable barrier, for example, using indicator or drill holes 8, as shown in FIG. 1. This additional layer allows for the creation of protection devices suitable for both females and males of all sizes and body types, by modifying the anti-trauma pad's shape to closely follow the contour of a variety of female and male anatomies, ensuring optimal ergonomics and minimizing trauma caused by the kinetic energy of the projectile.

The anti-trauma layer, or pad, can be molded by casting. In this process, liquid polyurethane is poured into the mold (using the force of gravity), and the mold is tipped on one side with the steel plate inside of it in order to have complete coverage. This layer has a very low industrial cost and is easy to produce, with a total weight ranging from 100-150 g, making this feature compatible with the protection system's use.

Figure 2:
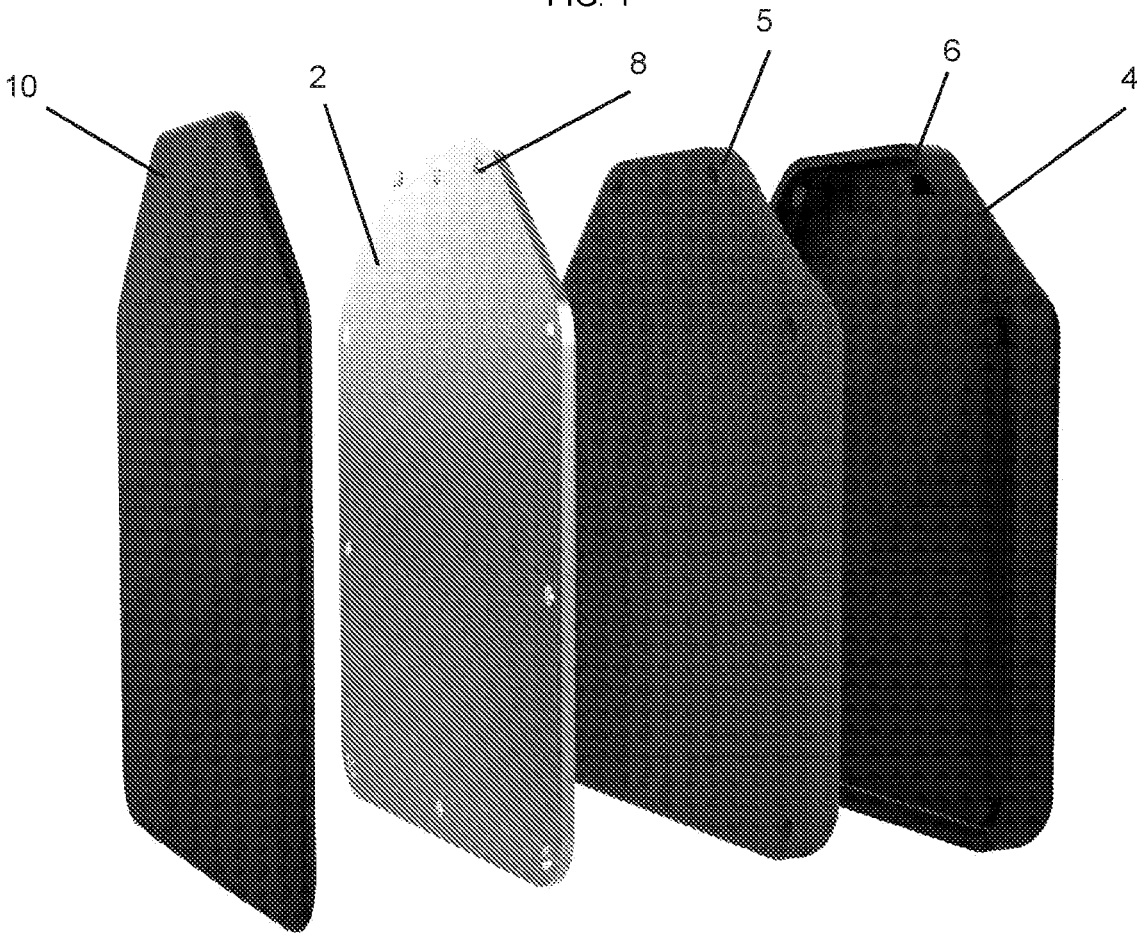
FIG. 2 shows an exploded view of an embodiment of the personal ballistic protection device with layers of protection.

In some embodiments, the ballistic impregnable barrier 2 may also have an anterior layer of protective material 10, as shown in FIG. 2. The additional anterior protective layer 10 may be an additional layer of material that is attached to the ballistic impregnable barrier 2, using any known method, for example mounting pylons 6 that fit within attachment holes 8 that are pre-drilled into the ballistic impregnable barrier, for example as shown in FIGS. 1 and 2.

In one such embodiment, the ballistic impregnable barrier 2 has an additional protective coating layer 10 that is intended to provide additional ballistic protection to the front side of the impregnable barrier 2 by absorbing kinetic energy and force of the bullets rather than reflecting or deflecting the bullets, which often shatters or breaks the coating or the bullets themselves. In preferred embodiments, this additional anterior layer is not intended to reflect or deflect the ballistic materials but rather absorb them and their kinetic energy.

Figure 3A:
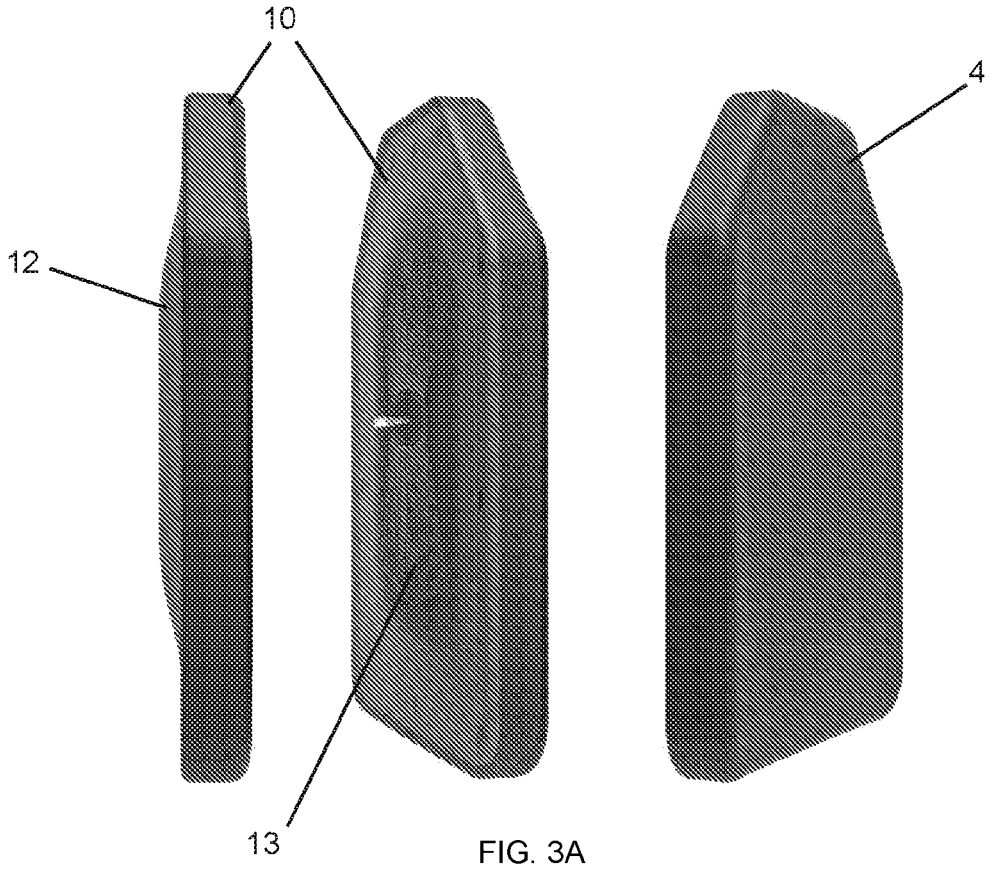
FIG. 3A shows side, front and back views of an embodiment with a failsafe bag in the anterior protective layer.
Figure 3B:
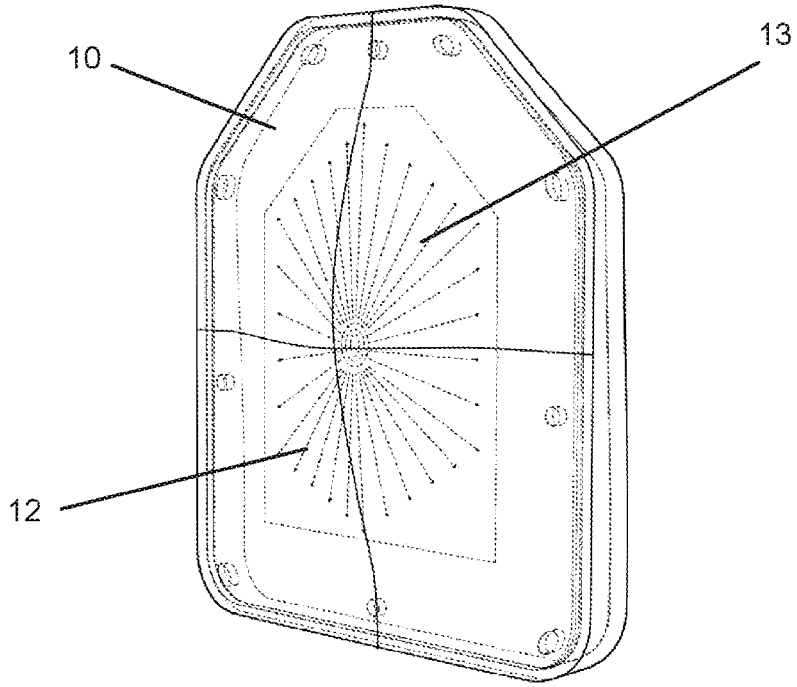
FIG. 3B shows a visualization of the flow and effects of kinetic energy and air movement within the embodiment shown in FIG. 3A.

In one version of this additional anterior protective layer 10, as shown in FIG. 3A, the anterior side of the ballistic impregnable barrier can have the form of a failsafe bag 12 or material to catch bullet fragments. FIGS. 3A and 3B show the spreading of the kinetic energy 13 through the front surface of the anterior protective layer 10 upon impact from a bullet.

In one such embodiment, the anterior protective coating layer can comprise a material, such as an inorganic fiber-reinforced material, that has a relatively low melting point. When a bullet strikes and enters the anterior protective layer, it experiences friction in the material as it decelerates, which generates heat as a result of the drag force acting on the bullet as it slows down, As the bullet slows, it emits heat into the anterior protective coating layer, such that the layer absorbs the bullet's energy, as shown in FIG. 3B, and the components of the layer melt and momentarily become a viscous fluid, swallowing up the residuals, i.e., bullet fragments, before almost fully resealing and closing the bullet entry point. The bullet residuals are held within the anterior protective layer after penetration of the first plastic layer, and the result is no ricochet of the bullet and no cracked surface on the ballistic device, but rather only highly localized damage to or slight deformation of the ballistic device surface anterior layer.

For example, certain materials provide an absorptive effect, i.e., wherein a bullet is effectively absorbed into the coating layer. In some embodiments, this additional anterior protective layer can be formed from a high-density polyurethane, multiblock copolymer polyurethane or some other complex polymer. The material of the anterior protective coating layer may also be selected from high-density polyethylene, polyethylene-vinyl acetate, polyurethane, polypropylene, polyester, polyamide, thermoplastic polyurethane, and polyolefin, or another such material known in the art. The material may be a visco-elastic elastomer or polymer, which has a chemical composition to absorb the kinetic energy of the bullet without deflecting the bullet or cracking the protective layer surface.

The anterior surface preferably has a dual-hardness structure, whereby the material partially absorbs the kinetic energy produced by the impact of the bullet and also mechanically contains the breaking and tearing stresses caused by bullet. The polymer may also have a chemical ability to almost completely "self-heal" after impact from the bullet, due to the high temperature created by the bullet when impacted against the high-density polyurethane. This special dual-hardness polyurethane coating must be formed and applied through a special process in order to ensure the mechanical integrity of the system, which must effectively contain all the bullet fragments it absorbs. It must also feed and channel the flows of kinetic energy and must further seal the bullet entry holes to ensure that the system remains almost airtight after absorbing the bullets.

The process essentially involves using a high-density auto-shell-creating commercial polyurethane of at least 4 mm, with an external hardness of approximately 90 Shore for about 1.5 mm and about 65 Shore for the remaining 2.8/3 mm that is internal to the harder shell. This combination ensures that the outer part retains the bullet fragments, while the inner portion remains with cells that are not completely closed.

The inner portion, thanks to its softer structure and the heat generated by the bullet in contact with the metal, instantly acts as a cautery/electrosurgical knife that almost completely seals the entry hole from the inside. In order to achieve this result, the cast polyurethane was cured in the mold and externally heated in an oven at a temperature of approximately 85° Celsius for a duration of 5 minutes.

Figure 4A:
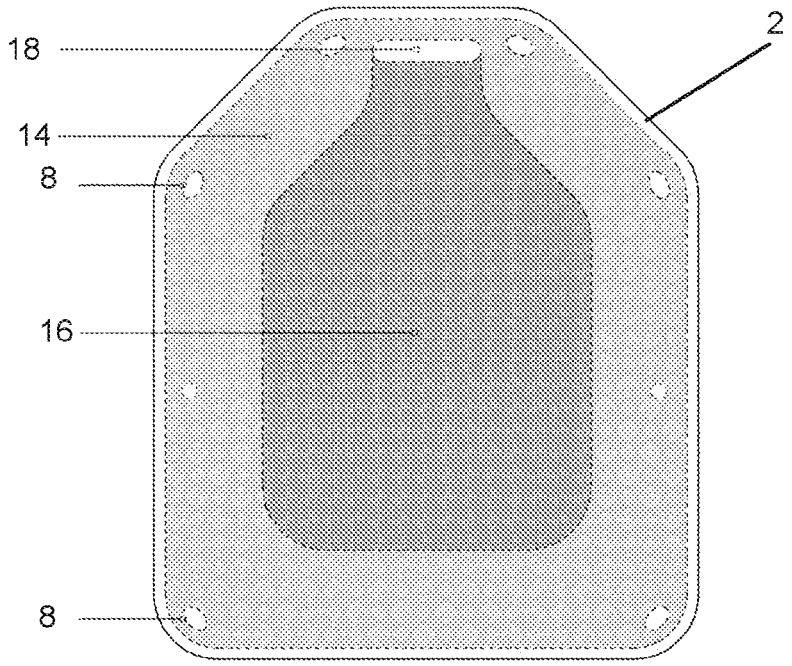
FIG. 4A shows a front or back view of a ballistic impregnable barrier that may be used with embodiments of the invention.
Figure 4B:
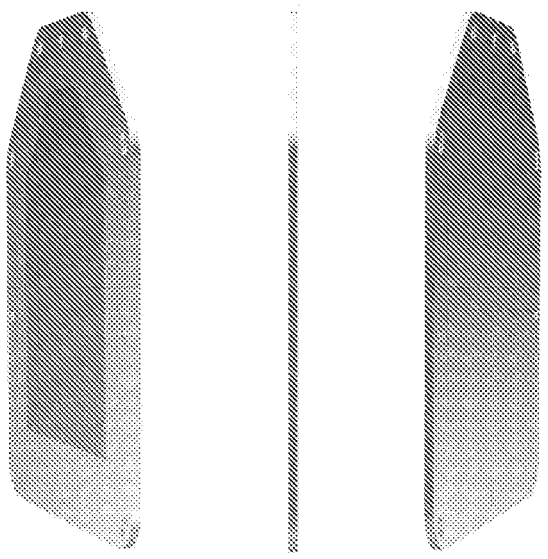
FIG. 4B shows front perspective, side and back perspective views of a ballistic impregnable barrier that may be used with embodiments of the invention.

In certain embodiments, as shown in FIGS. 4A and 4B, the anterior protective coating layer 10 is affixed to the anterior side of the ballistic impregnable barrier 2 only along a circumferential region 14, for example using pre-drilled holes 8 with mounting pylons 6 and an adhesive surface, but the but an internal region 16 has a non-stick element applied thereto. The ballistic impregnable barrier may have a non-stick compound applied directly thereto on an internal region, in order to create a defined space on the steel plate onto which the failsafe bag or other material, can expand, in order to be able to contain the absorbed fragments.

In some embodiments, the ballistic impregnable barrier may also have two separate posterior layers of protective material 4,5, as shown in FIG. 2. In one such embodiment, the posterior layer has an anti-trauma pad 4 that has reference locations for mounting against the ballistic impregnable barrier as well as a back face material, typically polyurethane, with mounting pylons 6 and back face closure.

In another embodiment, a first layer of material can be attached to the ballistic impregnable barrier in such a way that a gap is provided between that first posterior layer and the ballistic impregnable barrier. Then, a second material, preferably of a different hardness and density, can be injected into the gap between that first layer and the ballistic impregnable barrier to form a second posterior anti-trauma layer. The combination of these two layers, each of which can be formed of a material with a different density, provides superior trauma protection.

In order to allow a second layer of material region to be filled between the ballistic impregnable barrier and the first posterior layer of material, the first material is adhered to the posterior side of the ballistic impregnable barrier only at certain portions thereof, leaving space to be filled by the second material. For example, the first material can be adhered to the posterior side of the ballistic impregnable barrier only along a circumferential region 14, such that an internal region 16 has a non-stick surface, as shown in FIG. 4A. Thus, when the second material is injected behind the first layer of material, it pushes the first material away from the posterior side of the ballistic impregnable barrier at the internal region and fills that space.

In certain further embodiments, as discussed hereinabove, the most posterior of the anti-trauma layers can be molded to the contour of the wearer's body, specifically the torso, in order to further enhance the trauma protection.

In another embodiment, the personal ballistic protection device of the present invention has an additional posterior anti-trauma layer that may comprise an airbag. However, as described below, the airbag in the posterior anti-trauma layer is not initially filled with air, but the airbag system is activated by harnessing the kinetic energy produced by the bullet or other projectile when it impacts the anterior surface of the protective device.

Figure 5A:
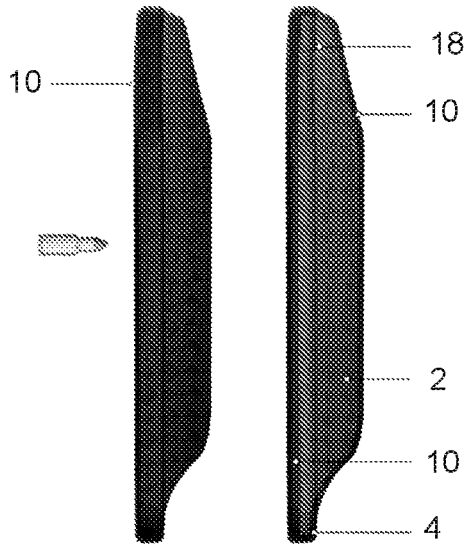
FIGS. 5A and 5B show side views of an embodiment with an airbag in the posterior protective layer.
Figure 5B:
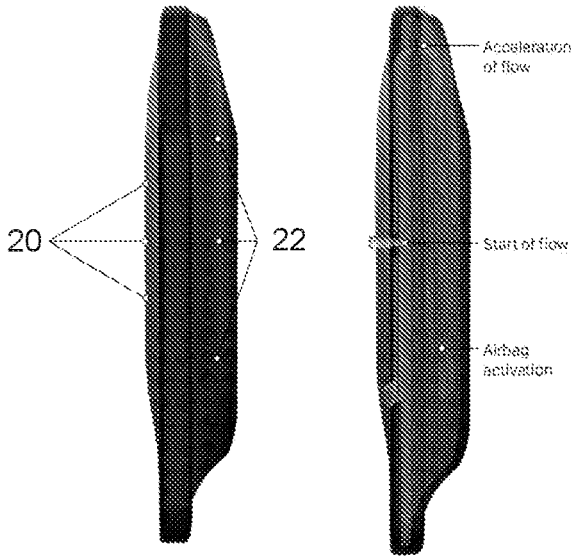

In one such embodiment, as shown in FIGS. 5A and 5B, this additional posterior trauma protection is like a personal airbag whose mechanism is arranged around the ballistic impregnable barrier, for example with a fluid- or gas-filled, in some embodiments an air-filled, safety sac on the anterior side of the steel plate and an empty airbag on the posterior side of the steel plate. The fluid in the air-filled sac can be compressed air.

As shown in FIG. 5A, which shows this embodiment prior to projectile impact, both the safety sac 20 within the anterior protective coating layer 10 on the anterior side of the steel plate and the airbag 22 on the posterior side of the impregnable barrier 2, e.g., steel plate, can be coated with or surrounded by a layer of high-density polyurethane.

The anterior air-filled sac 20 and the posterior air bag 22 are preferably in fluid communication. Fluid communication is provided between the safety sac 20 on the anterior side of the steel plate and the airbag 22 on the posterior side of the steel plate via at least one aperture 18 in the steel plate.

As shown in FIG. 5B, which shows this embodiment immediately after projectile impact, the airbag 22 is activated by the force of impact of a bullet against the anterior side of the impregnable barrier 2, which force accelerates airflow from the air-filled safety sac 20 on the anterior side, through the aperture 18, and around the impregnable barrier 2 to its posterior side so as to fill and activate the heretofore-empty airbag 22 on the posterior side. The air in the air-filled sac 20 can be compressed air.

Figure 6:
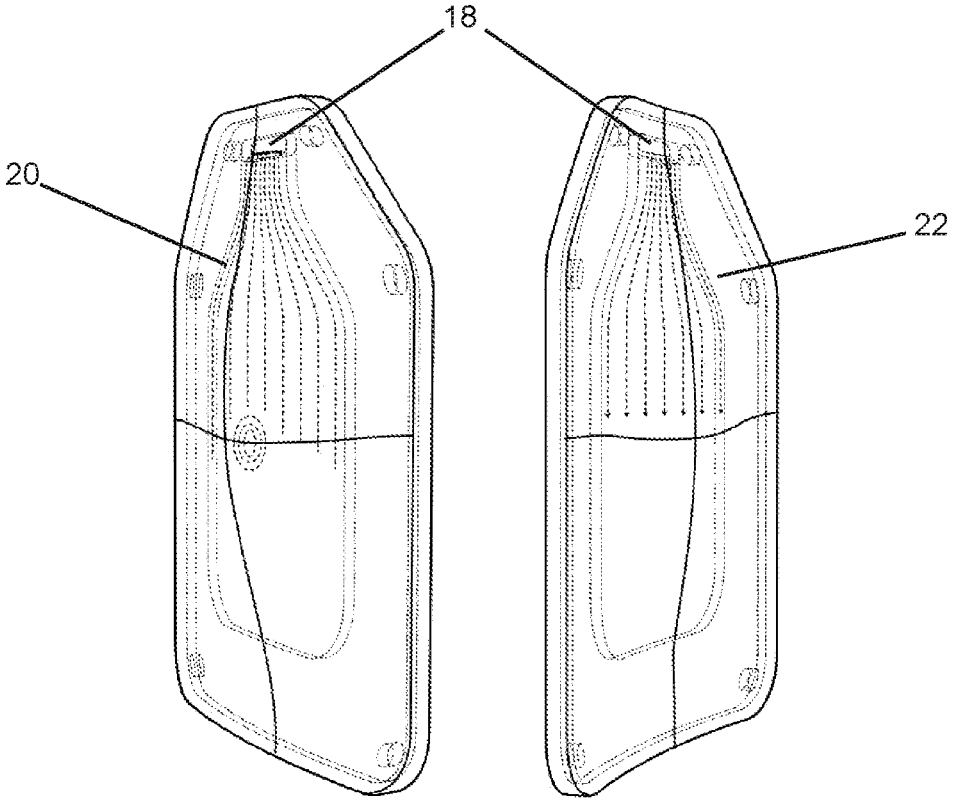
FIG. 6 shows a visualization of the flow and effects of kinetic energy and air movement within the embodiment shown in FIGS. 5A and 5B.

FIG. 6 shows a visualization of movement of the flow of kinetic energy and air during activation of the posterior anti-trauma airbag 22. When a bullet impacts the front side of the device, the kinetic energy of the bullet spreads through the anterior protective coating layer 10/safety sac compartment 20/fail-safe bag, thereby forcing air out of the air-filled sac 20. The air forced from the air-filled sac 20 travels around or, via an aperture 18, through the steel plate 2 into the posterior airbag 22. Thus, the force created by impact of a bullet to the front side of the device forces air to transfer from the anterior safety sac compartment 20, through at least one narrow aperture 18 along one or more edges of the device, to the empty airbag 22 on the posterior side, which instantly, and in proportion to the energy produced based upon the caliber of the bullet, inflates a sufficient amount to reduce trauma to the person wearing the device.

In one embodiment of the invention, the personal ballistic protection device has a sandwich-like structure, with multiple layers. In some embodiments, the air-filled sac 20 is situated between the anterior layer 10 of high-density polyurethane and the steel plate 2, and an evacuated air bag 22 is situated between the steel plate 2 and the trauma pad 4 on the posterior side of the steel plate. Thus, both the safety sac 20 on the anterior side of the steel plate 2 and the airbag 22 on the posterior side of the steel plate 2 may occupy a gap between the impregnable barrier 2 and the respective side's anti-trauma layer.

In order to allow the air-filled sac to be situated between the ballistic impregnable barrier and the anterior layer of high-density polyurethane, the polyurethane may be adhered to the anterior side of the ballistic impregnable barrier only at certain portions thereof, leaving space to be filled by the air-filled sac. For example, as shown in FIG. 4A, the polyurethane is adhered to the anterior side of the ballistic impregnable barrier only along a circumferential region, and an internal region has a non-stick surface. Thus, when the air sac is inserted behind the first layer of material, or as air is injected behind the polyurethane, it fills that space between the polyurethane and the anterior side of the ballistic impregnable barrier at the internal region thereof.

Similarly, in order to allow an airbag to be filled between the ballistic impregnable barrier and the trauma pad on the posterior side thereof, the trauma pad may be adhered to the posterior side of the ballistic impregnable barrier only at certain portions thereof, leaving space to be filled by air or an empty airbag. For example, as shown in FIG. 4A, the trauma pad is adhered to the posterior side of the ballistic impregnable barrier only along a circumferential region, and an internal region has a non-stick surface. Thus, when the air flows from the anterior air-filled sac to the posterior side, it pushes the trauma pad away from the posterior side of the ballistic impregnable barrier at the internal region and fills that space.

On the anterior side of the impregnable plate, the device may have a layer with a dual-hardness structure, whereby the material partially absorbs the kinetic energy produced by the impact of the bullet and also mechanically contains the breaking and tearing stresses caused by bullet, as discussed hereinabove with respect to FIGS. 3A and 3B. The polymer may also have a chemical ability to almost completely "self-heal" after impact from the bullet, due to the high temperature created by the bullet when impacted against the high-density polyurethane. Thus, in some embodiments, the anterior layers can have two functions. The failsafe bag can serve to collect fragments and residue created by the impact of the bullet, and the air-filled sac serves as the source of air to the posterior airbag. The air in the air-filled sac can be compressed air, gas or some other fluid that suits these needs.

Figure 7A:
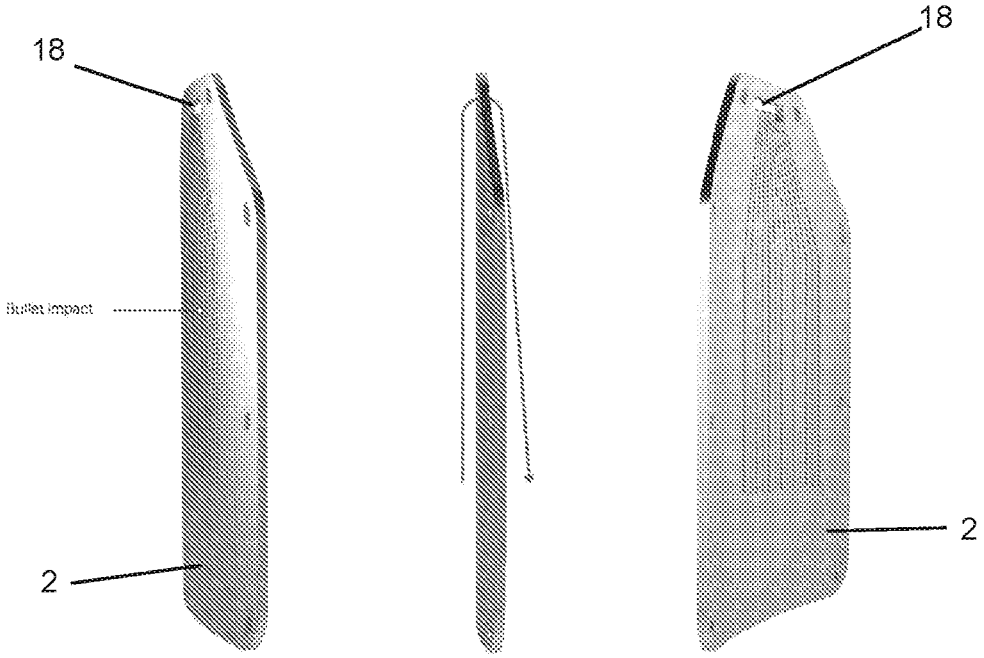
FIGS. 7A and 7B show a visualization of the air flow and movement about the front and back of the ballistic impregnable barrier within the embodiment shown in FIGS. 5A and 5B.
Figure 7B:
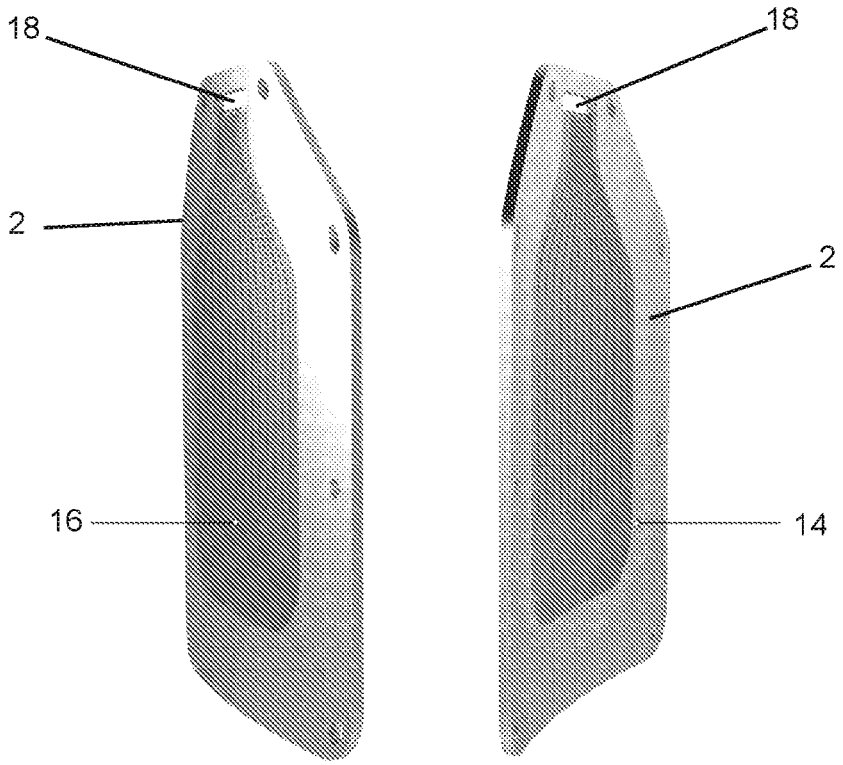

In preferred embodiments, as shown in FIGS. 7A and 7B, passage of the air from the anterior air-filled sac 20 into the posterior airbag 22 is almost instantaneous. This almost instantaneous passage of air can be due to the Venturi effect of the air passing through at least one narrow aperture 18 along one or more edges of the device. By constricting the flow of the air, the flow of the air can be sped up, such that its pressure is reduced, producing a partial vacuum. As the air leaves the aperture, or constriction, into the posterior airbag, its pressure increases back to the ambient level, filling the posterior airbag and allowing it to provide trauma relief.

FIGS. 7A and 7B also show the at least one aperture 18 for airflow passage between the anterior air-filled sac 20 and the posterior airbag 22. In certain embodiments, each aperture is approximately 0.3-0.4 $in^2$ in diameter. The size of the aperture can be larger or smaller to allow for faster or slower passage of the air from the anterior air-filled sac to the posterior airbag. In certain embodiments, the aperture can have a one-way valve, to allow air to pass from the anterior side to the posterior side but not from the posterior side to the anterior side.

The sudden influx of air into the airbag inflates the airbag, or the evacuated space between the ballistic impregnable barrier and the posterior trauma pad, pushing the trauma pad away from the steel plate and providing a buffer space between the steel plate and the trauma pad, thereby providing to the wearer additional reduction of the trauma produced by the impact of the bullet.

FIGS. 7A and 7B show a front view of the ballistic impregnable barrier 2, e.g., steel plate, onto which the air-filled sac 20 is situated, between the steel plate 2 and an anterior layer of high-density polyurethane, and a back view of the steel plate onto which the evacuated air bag is situated between the steel plate 2 and the posterior anti-trauma pad. The ballistic impregnable barrier may also have a non-stick compound applied directly thereto 16, in order to create a predefined space on the steel plate within which the polyurethane can expand in order to be able to contain additional air.

After activation of the trauma airbag, a small amount of air may be left in the anterior air-filled sac, and most of the air is transferred to the posterior airbag. The resulting air in the posterior airbag provides trauma protection for further impact against the anterior side of the shield.

In the embodiment described above, the anterior air-filled sac serves as the source of air to the posterior airbag. However, in certain other embodiments, as described below, the air that fills the posterior airbag comes from outside the ballistic protection device and enters the anterior layer along with the bullet.

For example, the anterior polymer coating may be formed of a material that contains bullet fragments in a front compartment, as described hereinabove with regard to FIGS. 3A and 3B. In this embodiment, the projectile, upon entry into the anterior polymer coating, also simultaneously channels air into a rear compartment airbag, which provides trauma protection for the wearer's chest, as described hereinabove with regard to FIGS. 5A and 5B. For example, when a bullet strikes and enters the anterior protective layer, the layer absorbs the bullet's energy, and the components of the layer melt and momentarily become a viscous fluid, swallowing up the bullet fragments, before almost fully resealing and closing the bullet entry point. However, in addition, upon penetration by the bullet of the first plastic layer of the anterior protective layer and prior to resealing of the bullet entry hole, air enters into the anterior protective layer along with the bullet.

Thus, in this embodiment, the air or other fluid is not initially contained within a front air sac before being transferred to a posterior airbag but rather is sucked into the anterior layer by vacuum upon creation of a bullet hole in the anterior surface and prior to the almost-immediate sealing of that bullet hole in the anterior surface. This airbag is thus activated by the bullet's kinetic energy.

These airbag areas are defined and utilized both in the front and rear sections of the ballistic protection device and are connected through the aperture in the ballistic barrier. These areas are designed using the Venturi flow system, which, owing to the kinetic energy produced and proportional to the caliber of the bullet itself, increases the speed of the air in the upper/front of the ballistic barrier to direct it through the upper passage of the ballistic barrier, conveying it to the posterior side of the barrier, decreasing the speed and increasing the pressure of the flows, feeding and inflating the rear compartment, thereby considerably reducing the trauma caused.

To create the active and passive airbag systems, it is necessary to form the ballistic shield externally with polyurethane applied through a special process. As described above, the process essentially involves using a high-density auto-shell-creating commercial polyurethane of at least 4 mm, with an external hardness of approximately 90 Shore for about 1.5 mm and about 65 Shore for the remaining 2.8/3 mm. The cast polyurethane is cured in the mold and externally heated in an oven at a temperature of approximately 85° Celsius for a duration of 5 minutes. This combination ensures that the outer part retains the bullet fragments, while the inner portion remains with cells that are not completely closed. The inner portion, thanks to its softer structure and the heat generated by the bullet in contact with the metal, instantly acts as a cautery/electrosurgical knife that almost completely seals the entry hole from the inside.

While certain features of the present invention have been described and illustrated herein, it should be understood that many modifications, substitutions, changes, and equivalents may occur to those of ordinary skill in the art without departing from the spirit and scope of the invention. Accordingly, the invention is intended to embrace all such modifications, substitutions, changes, and variations as fall within the scope of the appended claims, and the appended claims are intended to cover all such modifications and changes as fall with the true spirit of the invention.

The invention claimed is:

1. A personal ballistic protective device comprising:

a ballistic impregnable barrier formed of steel or synthetic ballistic material;

an anterior layer positioned on a front side of the ballistic impregnable barrier, the anterior layer comprising a polymeric material configured to absorb and retain projectile fragments upon projectile impact; and a posterior trauma protection layer positioned on a rear side of the ballistic impregnable barrier, the posterior trauma protection layer comprising a molded low-density polymeric foam;

wherein the ballistic impregnable barrier includes at least one aperture providing fluid communication between the anterior layer and the posterior trauma protection layer; and wherein impact by a projectile causes airflow through the aperture from the anterior side to the posterior trauma protection layer to reduce trauma to the wearer.

2. The device of claim 1, wherein the anterior layer comprises high-density polyurethane having a dual-hardness structure.

3. The device of claim 2, wherein the dual-hardness structure of the anterior layer comprises a harder outer shell enclosing a softer inner material.

4. The device of claim 3, wherein the outer shell has a hardness of 90 Shore, and the inner material has a hardness of 65 Shore.

5. The device of claim 3, wherein the anterior layer has a structure configured to collect projectile fragments.

6. The device of claim 5, wherein the anterior layer self-heals upon projectile impact by heat sealing a site of projectile penetration.

7. The device of claim 1, wherein the posterior trauma protection layer is shaped to conform to a wearer's torso.

8. The device of claim 1, wherein the posterior trauma protection layer comprises an inflatable airbag activated by fluid passing through the aperture.

9. The device of claim 8, wherein the airflow through the aperture is accelerated by a Venturi effect.

10. The device of claim 8, wherein the anterior layer comprises a fluid-filled sac from which fluid, upon impact of a ballistic projectile onto the anterior layer, is forced through the aperture and into the inflatable airbag.

11. The device of claim 8, wherein the anterior layer comprises a structure that, upon penetration of a ballistic projectile into the anterior layer, allows entry of external air along with the projectile at a site of said projectile penetration.

12. The device of claim 11, wherein the anterior layer self-heals upon projectile impact by heat sealing the site of projectile penetration, whereby the external air, by force of the ballistic projectile onto the anterior layer, is forced through the aperture and into the inflatable airbag.

* * * * *